US005176352A

United States Patent [19]

Braun

[11] Patent Number: 5,176,352

[45] Date of Patent: Jan. 5, 1993

[54] INTERCHANGEABLE FOOD DISPLAY SYSTEM

[76] Inventor: Heinz J. Braun, P.O. Box 770, Havertown, Pa. 19083

[21] Appl. No.: 607,235

[22] Filed: Oct. 31, 1990

[51] Int. Cl.[5] ..... A47B 91/00

[52] U.S. Cl. ..... 248/346; 40/323

[58] Field of Search ..... 248/346, 176; 108/11, 108/13, 51.3, 153; 211/126; 312/224; 40/323; 206/557, 511; 99/646 R

[56] References Cited

U.S. PATENT DOCUMENTS

| | | | |
|---|---|---|---|
| 303,218 | 9/1989 | Long | D9/456 |
| 758,777 | 5/1904 | Pelugradt | 211/126 X |
| 1,355,072 | 10/1920 | Bornstein | 206/557 |
| 1,447,364 | 3/1923 | Walker | 312/224 X |
| 2,469,530 | 5/1949 | Thompson | 206/557 X |
| 3,851,808 | 12/1974 | Schilling | 206/557 X |
| 4,399,972 | 8/1983 | McCulloch | 108/51.3 X |
| 4,679,691 | 7/1987 | Halloran | 40/323 X |
| 4,685,568 | 8/1987 | Elsfelder | 206/561 |
| 4,738,426 | 4/1988 | Bessinger | 248/250 |
| 4,986,418 | 1/1991 | Gwathmey | 248/346 X |
| 4,991,718 | 2/1991 | Withers | 206/511 |

FOREIGN PATENT DOCUMENTS

| | | | |
|---|---|---|---|
| 758018 | 9/1956 | United Kingdom | 206/557 |
| 1082657 | 9/1967 | United Kingdom | 206/557 |
| 2212139 | 7/1989 | United Kingdom | 206/557 |

*Primary Examiner*—J. Franklin Foss

*Attorney, Agent, or Firm*—William H. Murray

[57] ABSTRACT

An interchangeable food display system includes a frame into which is removably inserted a display surface panel and display support panel. The display surface panel and display panel support are retained within the frame by three spring loaded support strips. The support strips are removably attached to the frame by means of screws which are screwed into screw inserts which are disposed and retained within the frame. Display surface panels, presenting different appearances, such a mirrored surface, a colored surface or a surfaces having other designs, are interchangeable so that the system can be tailored to different types of displays.

12 Claims, 5 Drawing Sheets

FIG. 2
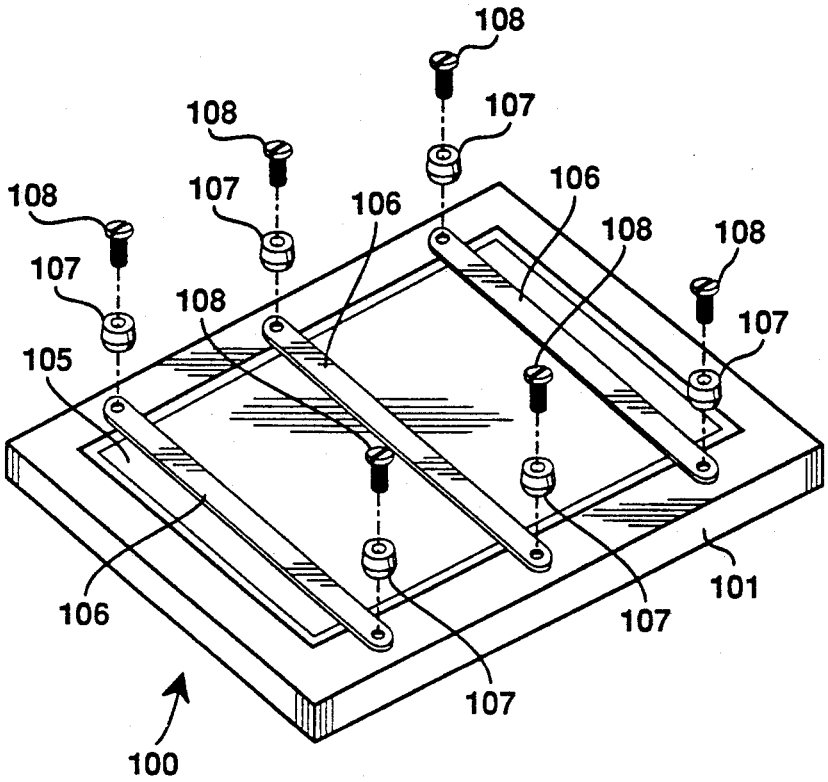
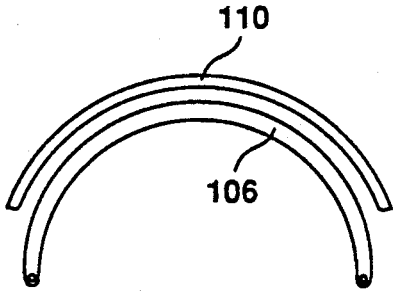
FIG. 6

INTERCHANGEABLE FOOD DISPLAY SYSTEM

BACKGROUND OF THE INVENTION

The present invention relates to food display apparatus and more particularly to apparatus for supporting and displaying food dishes in an attractive manner.

In the food preparation and service industry, the current method of displaying prepared food dishes depends heavily on mirrors. Mirror displays are standard on buffets, for amenities, for room service displays, and center pieces for tables. Hotels, caterers, restaurants, party equipment rentals and florists routinely utilize mirror displays.

The mirror displays presently used typically consist of a mirror permanently fastened to a support surface. Some support surfaces have rims while others do not. Breakage of the mirror portions of the displays is an ongoing, expensive problem. A broken mirror represents a total loss of the investment in the display unit and usually means that the broken unit is simply discarded and replaced by a new unit.

SUMMARY OF THE INVENTION

It is therefore an object of the present invention to provide a food display system which does not have to be discarded upon breakage of one of its components.

Another object of the present invention is to provide a food display system in which the parts are easily interchangeable.

Yet another object of the present invention is to provide a food display system for which there are multiple display inserts which can be installed or removed as desired to create a desired display effect.

These and other objects of the present invention are obtained by providing a food display system comprising a frame, a display surface panel removably inserted in the frame; removable means for supporting the display surface panel within frame; and means for removably retaining the display surface panel and panel support means within the frame.

Other objects, features and advantages of the present invention will be more fully apparent from the following detailed description of the preferred embodiment, the appended claims and the accompanying drawing.

BRIEF DESCRIPTION OF THE DRAWING

The FIG. 1 is an exploded perspective view depicting components of a preferred embodiment of the interchangeable food display system in accordance with the present invention.

FIG. 2 is a partially exploded bottom perspective view of a preferred embodiment of the interchangeable food display system in accordance with the present invention.

FIG. 6 is a side view of a spring-loaded support strip and gasket of a preferred embodiment of the interchangeable food display system in accordance with the present invention.

DETAILED DESCRIPTION OF THE INVENTION

Figure 1:
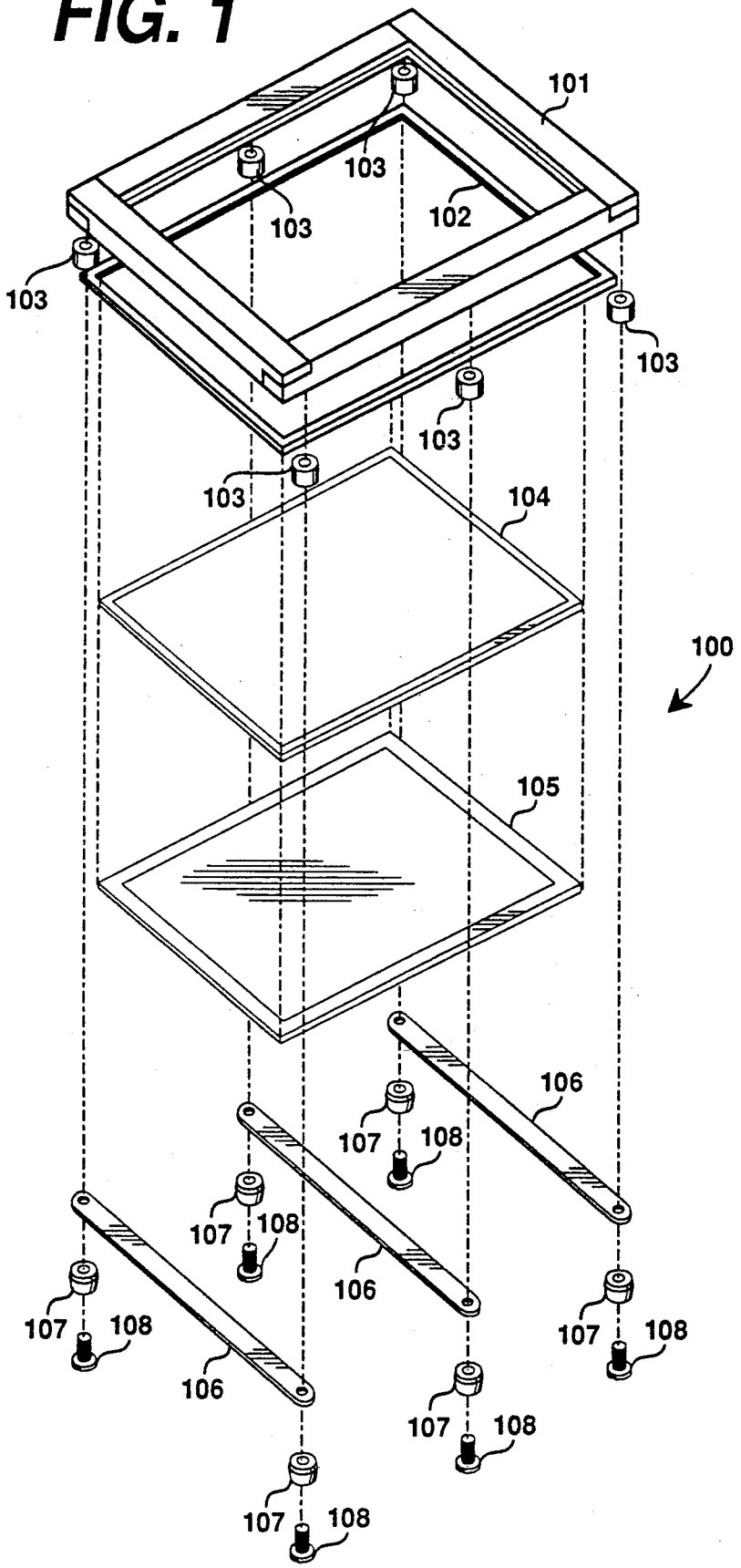
Figure 3:
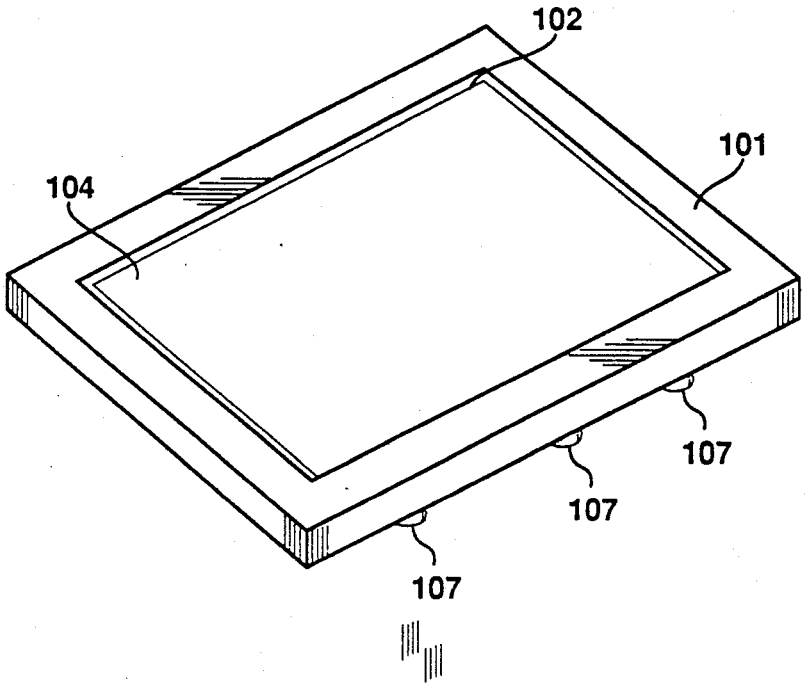
FIG. 3 is a top perspective view of an assembled interchangeable food display system in accordance with the present invention.
Figure 4:
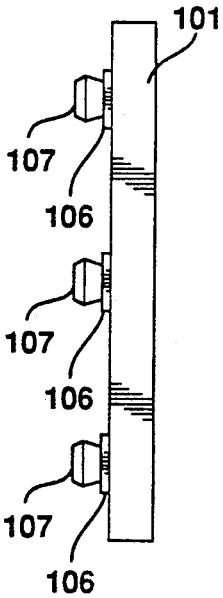
FIG. 4 is a side view of the interchangeable food display system depicted in FIG. 3.
Figure 5:
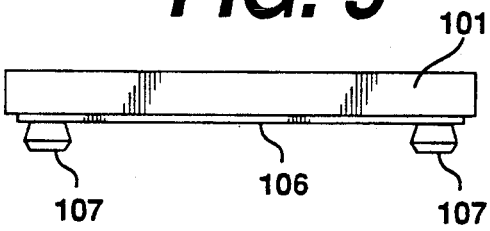
FIG. 5 is an end view of the interchangeable food display system depicted in FIG. 3.

Referring to FIG. 1 there is depicted an exploded view of a preferred embodiment of the interchangeable food display system of the present invention, generally designated 100. The food display system 100 comprises a frame plate 101. In the embodiment depicted in FIG. 1, the frame plate 101 is substantially rectangular. It should be noted that the frame plate could be square, round, oval, diamond-shaped, heart shaped, hourglass shaped, octagon, half-round, fish-shaped, Yin-Yang, or any other type of attractive circumferential shape. In the preferred embodiment, the frame plate 101 is constructed of wood. However, the frame plate could also be constructed of a metal such as stainless steel, brass, or anodized aluminum; and could also be constructed of synthetic materials such as thermoplastics which are rigid enough to provide support to removably inserted panels and supporting members as will be subsequently described.

The inner circumference of the underside of the frame 101 is sized to receive a display surface panel 104. The inner circumference of the frame plate contains a lip which retains the display surface panel 104 seated within the frame plate 101. In the preferred embodiment, a gasket 102 is disposed between the display surface 104 and the lip of the frame plate 101. The gasket 102 extends around the periphery of the display surface panel 104 and provides a shock absorbing seal between the display surface panel 104 and the frame plate 101.

The display surface panel 104 has an upper surface which, when inserted into the frame plate 101, presents an attractive appearance. The display surface panel 104 can be a mirror or a colored synthetic material such as a thermoplastic. The display panel 104 may also be metal such as stainless steel, brass or anodized aluminum. It may also be a naturally occurring material such as a sheet of slate or stone. The basic requirement of the display surface panel 104 is that it possess a finish which, when inserted within the frame plate 101, gives an attractive appearance to the food display system. The gasket 102 material may be rubber, felt or other material suitable for forming a shock absorbent type seal between the display panel 104 and the frame plate 101.

A display panel support 105 is inserted into the frame plate 101 behind the display surface panel 104. The display panel support 105 is a sheet of material, such as a thermoplastic material, metal, or other material which, in sheet form, will provide a substantially rigid support for the display surface panel 104. The outer circumference of the display panel support 105 is substantially the same size and shape as that of the display surface panel 104.

Support strips 106 ar utilized to retain the display support panel 105 and display surface panel 104 within the frame plate 101. In the preferred embodiment, there are three support strips 106. However, it should be noted that the use of one, two or four or more strips 106 is within the scope and contemplation of the present invention. Each support strip 106 comprises a spring loaded strip of metal preferably formed in an arctuate configuration as shown in FIG. 6. The support strip 106 is constructed of a material which will retain its substantially arctuate configuration when in the unloaded stated. Examples of such material include a metal such as steel or a thermoplastic material. In the preferred embodiment, each support strip 106 comprises spring steel and is lined with a gasket material 110 (see FIG. 6).

The support strips 106 are fastened to the underside of the frame plate 101 using fastening means comprising screw inserts 103 and mating screws 108. the screw inserts 103 are inserted and retained within the frame plate 101. The screws 108 are inserted through risers 107 and apertures in each support strip 106 into engagement with respective mating screw inserts 103. Each support strip 106 is held in place with a pair of screws 108 with the convex side of the support strip 106 in engagement with the underside of the display panel support 105. The gasket material 110 (see FIG. 6) is disposed between the support strip 106 and the underside of the display panel support 105.

Figure 7:
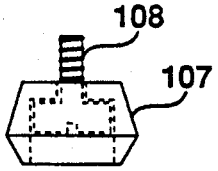
FIG. 7 is an enlarged view of a fastener component of a preferred embodiment of the interchangeable food display system in accordance with the present invention.

The head of each screw 108 is recessed within a riser 107 as depicted in FIG. 7. It is preferred that the risers 107 are formed of a soft, nonskid material such as rubber or a thermoplastic material. In the assembled configuration, the riser 107 will act as nonskid, shock absorbing support feet for the food display system.

Figure 8:
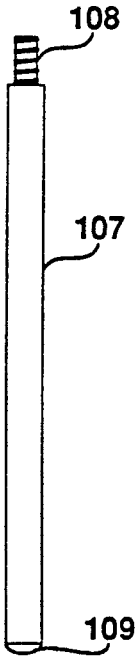
FIG. 8 depicts an elongated rigid riser of an alternate preferred embodiment of the present invention.

It should also be noted that the risers 107 may be constructed of a rigid material such as metal, wood or a rigid thermoplastic material. These rigid risers are elongated and are constructed having a screw 108 extending from one end thereof and having a soft, nonskid cap on the other end thereof as shown in FIG. 8.

Elongated risers of equal length are utilized in connection with the interchangeable food system when a tiered presentation is desirable. In such case, the screws 108 extending from the end of the risers are screwed into the screw inserts 103 with the other end of the riser either sitting on a support surface or sitting in a receiving indentation on another interchangeable food display system disposed underneath. In another embodiment, two elongated risers may be used on the rear part of the system with two short risers utilized on the front thereby causing the system to be tilted with the rear portion being elevated with respect to the front portion.

When it is desired to replace the display surface panel 104, either because of breakage of the panel or because it is desired to create a different effect by the food display system, the screws 108 are unscrewed from the screw inserts 103 thereby releasing the support strips 106. The display panel support 105 and display surface panel 104 are removed from the frame plate 101. A new display surface panel 104 is then reinserted into the frame plate 101, preferably with the gasket 102 disposed between the lip of the display surface panel 104 and the frame plate 101.

The display panel support 105 is then inserted into the frame plate behind the new display surface panel 104. The support strips 106, with the gasket material 110 thereon, are assembled onto the frame plate 101 with the convex side toward the display panel support 105 in order to retain the display panel support 105 and display surface panel 104 within the frame plate 101. As previously described, the support strips 106 are fastened to the frame plate 101 using the screws 108 which are screwed into the mating screw inserts 103 through the risers 107 and the apertures in the support strips 106.

Figure 9:
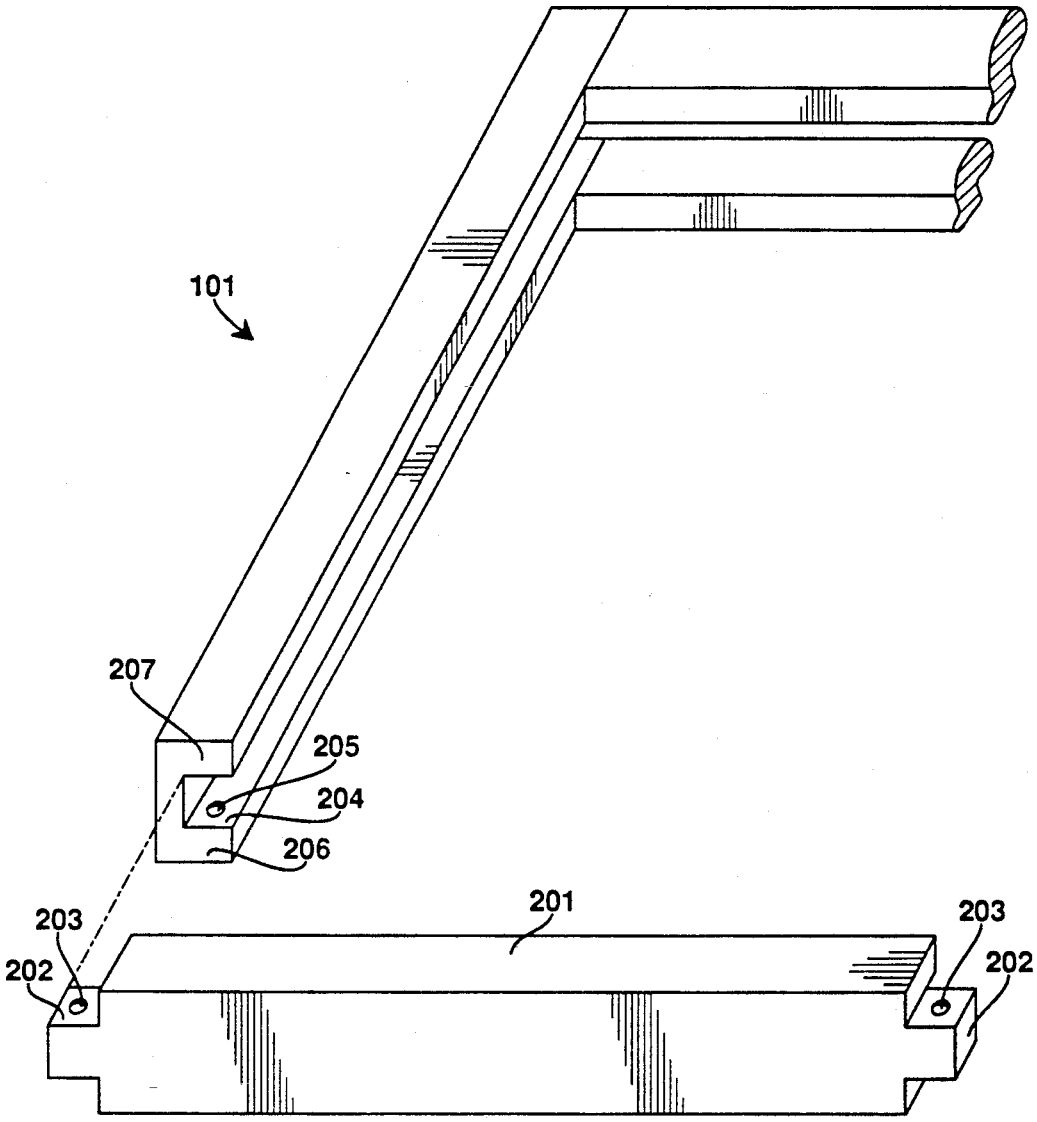
FIG. 9 is a partially broken top perspective view of an alternate embodiment of the present invention depicting a removable end portion of a frame plate to facilitate removal and insertion of a display surface panel.

In an alternate preferred embodiment of the present invention, the display surface panel 104 can be slideably inserted and removed by removing an end of the frame plate 101. In this embodiment, depicted in FIG. 9, an end portion 201 of the frame plate 101 is removably attached to the remainder of the frame plate using, for example, the screws 108 extending from the risers 107. In this embodiment, each end of the removable end portion 201 of the frame plate 101 has a tab 202 with an aperture 203 therethrough. Each tab 202 matingly engages a slot 204 at each open end of the frame plate 101. The slot 204 extends around the inner periphery of the frame plate 101 and retains the inserted display surface panel 104 within the frame plate 101. The screw 108 passes through a aperture 205 in the lower portion 206 of the slot 204, the aperture 203 in the tab 202 and matingly engages a screw insert (not shown) disposed within the top portion 207 of the slot 204. To replace a display surface panel, the screws 108 are disengaged from the end portion 201 of the end plate 101. The end portion 201 of the frame plate 101 is then removed thereby permitting the display surface panel (not shown) to be slidingly removed from the slot 204 in the inner periphery of the frame plate 101. A different display surface panel 104 may then be slidingly reinserted into the slot 204 of the frame plate 101 following which the end portion 201 is refastened to the frame plate 101 using the screws 108.

In yet another alternate preferred embodiment of the present invention, the frame plate 101 has a recessed lip around the inner periphery thereof which supports a display surface panel 104 which is inserted into place from the top. In this embodiment, the display surface panel 104 is removed by inverting the frame plate 101 allowing the display surface panel to become disengaged from the recess formed by the inner periphery and inner lip of the frame plate 101.

As can be seen from the above description, the interchangeable food display system in accordance with the present invention enables the user to easily replace the display surface panel 104 in order to either replace a broken display surface panel or to create a new display effect. For example, a mirrored display surface panel 104 could be replaced by a black display surface panel 104 which would create an entirely different effect. Similarly a display surface panel 104 comprising stone or slate could be used to create yet another different effect from either the mirrored or the colored panel.

It will be understood that various changes in the details, materials and arrangements of parts which have herein been described and illustrated in order to explain the nature of this invention may be made by those skilled in the art within the principle and scope of the invention as expressed in the following claims.

I claim:

1. A food display system comprising:

a) a frame;

b) a display surface panel removably inserted in said frame;

c) removable means for supporting said display surface panel within said frame; and d) means for removably retaining said display surface panel and said display surface panel support means within said frame comprising:

i) at least two screw inserts inserted and retained within said frame;

ii) at least one support strip having an arctuate shape in the unloaded configuration and an aperture at each end thereof; and iii) screw means inserted through he apertures at each end of said support strip, said screw means matingly engaging said screw inserts whereby said support strips are maintained in tension against said display surface panel support means.

2. The food display system in accordance with claim 1 additionally comprising a riser surrounding the head of each screw means.

3. The food display system in accordance with claim 2 wherein at least one of said risers has a length which is greater than the other risers.

4. The food display system in accordance with claim 1 comprising three support strips.

5. A food display system comprising:

a) a substantially rectangular wooden frame;

b) a substantially rectangular display surface panel removably inserted in said frame;

c) a display panel support member removably inserted into said frame behind said display surface panel;

d) three support strips removably fastened to said frame, said support strips having an arctuate configuration with a convex side and concave side, said convex side being maintained in tension against said display panel support.

6. A food display system in accordance with claim 5 wherein said display surface panel comprises a mirror.

7. A food display system in accordance with claim 5 wherein said display panel is colored in accordance with a predetermined color scheme.

8. A food display system in accordance with claim 5 additionally comprising screw means inserted through apertures at the end of each support strip, said screw means mating engaging said screw inserts whereby said support strips are maintained in tension against said display surface panel support means; and a riser surrounds the head of each screw means, at least one of said risers being elongated with respect to the other of said risers.

9. The food display system in accordance with claim 5 wherein said frame includes a slot extending around the inner periphery thereof for retaining said display surface panel and said display panel support member within said frame; and means for removably retaining said display surface panel comprising an end portion removably connected to said frame.

10. A food display system in accordance with claim 5 wherein said frame comprises wood.

11. A food display system in accordance with claim 5 wherein said frame comprises metal.

12. A food display system in accordance with claim 5 wherein said frame comprises a thermoplastic material.

* * * * *